United States Patent [19]

Tacheny et al.

[11] Patent Number: 4,726,092

[45] Date of Patent: Feb. 23, 1988

[54] CASEMENT WINDOW HINGE

[75] Inventors: John C. Tacheny, Owatonna; Anthony C. Schema, Faribault, both of Minn.

[73] Assignee: Truth Incorporated, Owatonna, Minn.

[21] Appl. No.: 860,888

[22] Filed: May 8, 1986

[51] Int. Cl.[4] ..... E05D 15/00

[52] U.S. Cl. ..... 16/364; 16/370; 16/342; 16/368

[58] Field of Search ..... 16/366, 368, 369, 370, 16/363, 364, 352, 342

[56] References Cited

U.S. PATENT DOCUMENTS

| | | | |
|---|---|---|---|
| 1,271,380 | 7/1918 | Soule | 16/370 |
| 1,876,402 | 9/1932 | Cramer | 16/364 |
| 2,001,356 | 5/1935 | Bates | 16/370 |
| 2,398,017 | 4/1946 | Lidin | 16/370 |
| 3,071,219 | 1/1963 | Vuncannon | 16/370 |
| 3,345,777 | 10/1967 | Anderberg | 16/364 |
| 3,939,529 | 2/1976 | Davies | 16/342 |
| 4,102,012 | 7/1978 | Davis | 16/179 |
| 4,226,002 | 10/1980 | Davis | 16/179 |
| 4,555,829 | 12/1985 | Davies | 16/370 |
| 4,571,776 | 2/1986 | Taylor | 16/339 |

FOREIGN PATENT DOCUMENTS

| | | | |
|---|---|---|---|
| 2506613 | 8/1976 | Fed. Rep. of Germany | 16/364 |

OTHER PUBLICATIONS

Copy each of pp. 16 and 17 of Truth Incorporated catalog of Jul. 1983.

*Primary Examiner*—Kurt Rowan

*Attorney, Agent, or Firm*—Wood, Dalton, Phillips, Mason & Rowe

[57] ABSTRACT

A hinge for a casement window having components releasably held in positions related to each other to provide for movement of a window-supporting sash arm between closed and egress positions. The structure includes a support arm pivotally connected between a track of the hinge and the sash arm. The pivot mounting of the support arm to the track, or the effective length of the support arm can be varied to enable movement of the window sash from an egress position to a washability position.

18 Claims, 18 Drawing Figures

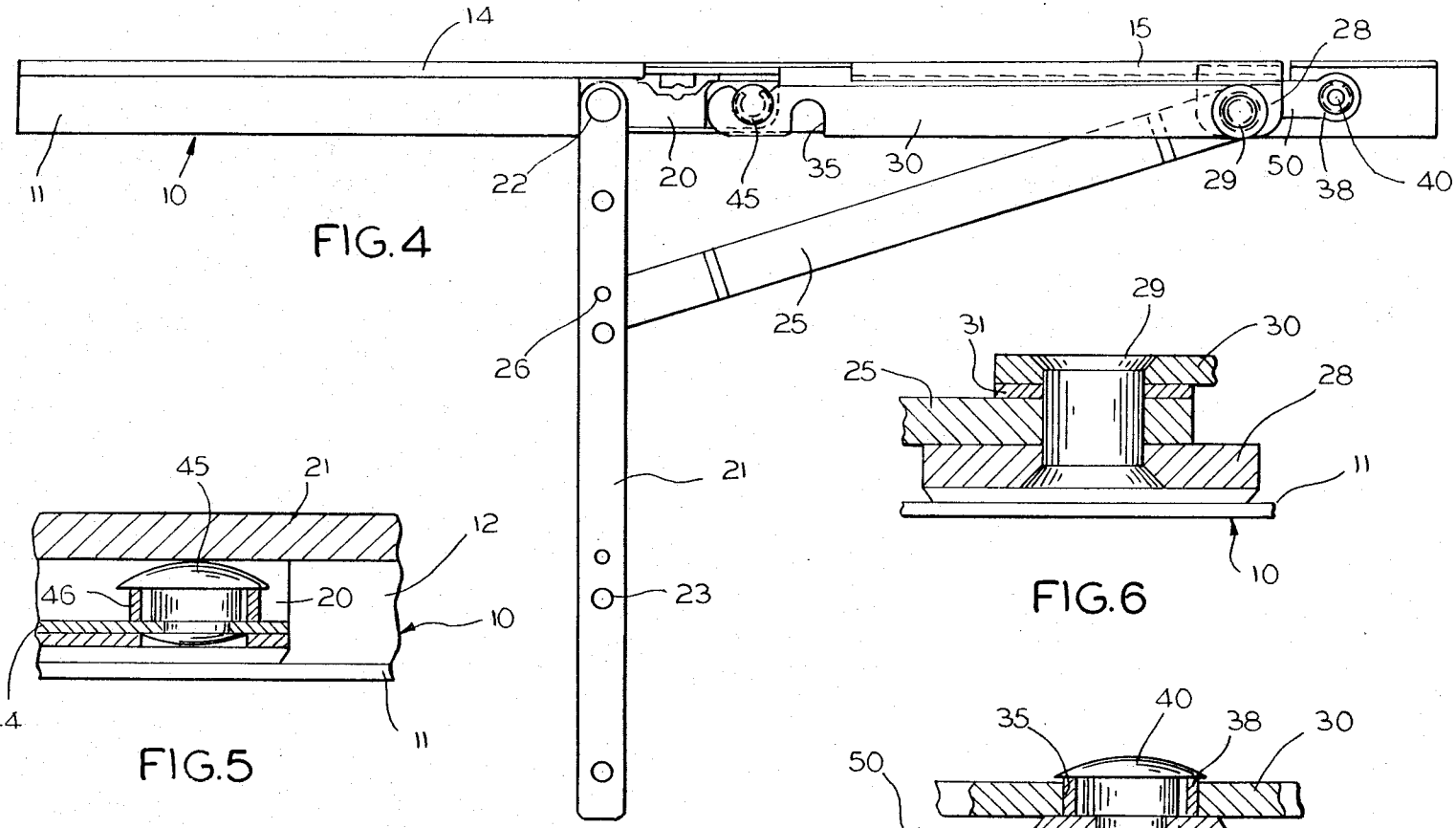
FIG.4
FIG.6
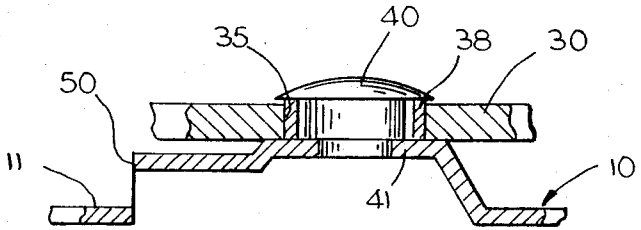
FIG.7
FIG.5

CASEMENT WINDOW HINGE

DESCRIPTION

1. Technical Field

This invention pertains to a casement window hinge providing for normal operation of a window sash between a closed position and a fully-open, egress position as well as optional movement to a washability position. In normal operation, the window sash of a casement window can move to a fully-open, egress position offset in the window opening to enable escape through the window in an emergency. This position does not permit easy access to the outer side of the window sash for cleaning. It is desirable to provide for selective movement of the window sash to a washability position, generally centered within the window opening for free access to both sides of the sash from within the room to facilitate window cleaning.

2. Background Art

The casement window has a window sash movably mounted within a frame by a pair of hinges mounted between the window frame and the top and bottom of the window sash. It is typical of such a hinge to have a track mountable to the window frame and a sash arm connectable to the window sash. A support arm interconnects the track and the sash arm, with the support arm being pivotally connected to both the track and the sash arm. The sash arm is pivotally connected either directly or by means of an interconnecting link to a mounting shoe which is movably guided for movement lengthwise of the track. Another type of casement window hinge differs from the just-described window hinge in having the sash arm pivotally connected to the track by an intervening link, with the intervening link being pivotally fixed to the track, rather than to a movable shoe, and with a support arm pivotally connected to the sash arm also being pivotally mounted to a shoe movably guided on the track for movement lengthwise of the track.

In both of the foregoing types of casement window hinge, the window sash can move between closed position and an egress position in normal operation and when in egress position, the window sash extends generally normal to the window frame and adjacent one side of the window frame. This egress position maximizes the amount of unobstructed opening to facilitate escape through the window in the event of an emergency. In the egress position, the inside of the window can be easily cleaned from the room interior. However, the outside of the window is not readily accessible. One construction of a casement window hinge to enable movement of the window sash from an egress position to a washability position is shown in Taylor U.S. Pat. No. 4,571,776.

DISCLOSURE OF THE INVENTION

A primary feature of the invention is to provide a hinge for a casement window which, by minimal modification of the prior existing structure, enables a window sash supported by a pair of the hinges to move from an egress position to a washability position. A plurality of disclosed embodiments of the invention provide for this operation by either providing for a variation in the length of the support arm or by shifting the pivot mounting of the support arm along the track of the hinge.

In one embodiment of the invention, the window hinge comprises a track mountable to a window frame and having a movable mounting shoe which pivotally mounts one end of a sash arm connectable to a window sash. A support arm is pivotally connected at one end to the sash arm intermediate the ends of the sash arm and at its other end is pivotally connected to an anchor shoe which is normally held in fixed position on the track. In normal operation, the sash moves between closed and egress positions by movement of the mounting shoe along the guide track and with pivotal movement of the sash arm controlled by the support arm. When it is desired to move the window sash to a washability position, an anchor shoe, to which an end of the support arm is pivotally connected, is released for movement along the track. An anchor arm, which normally holds the anchor shoe fixed to the track, is connected to the mounting shoe whereby both shoes can move along the track in unison to move the sash to washability position.

In another embodiment of the invention, the hinge has a track mountable on a window frame and movably mounts a mounting shoe to which an end of the sash arm is pivotally connected and a support arm is pivotally connected at one end to the sash arm and, at its other end, is pivotally connected to the track. The support arm is formed of two support arm sections in overlapped relation and which are pivotally connected together. In normal movement of the window sash between closed and egress positions, the support arm sections are locked together in an overlapped, straight-line relation. When the window sash is to move from egress position to a washability position, the support arm sections are freed for pivoting movement of one relative to the other to effectively reduce the length of the support arm, whereby the sash arm and mounting shoe can move a further distance along the track, with resulting movement of the window sash to washability position.

In a third embodiment, a track is mountable to a window frame and has a movably-mounted mounting shoe which pivotally supports one end of a sash arm connectable to a window sash with a support arm extending between the track and the sash arm and having its opposite ends pivotally connected thereto. The support arm is formed of a pair of support arm sections which are normally in overlapped straight-line relation and which are provided with means for holding the support arm sections in a maximum-length position. Said holding means is releasable to permit shortening of the overall length of the support arm to permit further movement of the mounting shoe along the track and resulting movement of the window sash to washability position.

An object of the invention is to provide a hinge for a casement window providing for normal operation of a window sash to and from an egress position and for movement therefrom to a washability position comprising, a track mountable on a window frame, a mounting shoe movable along the track, a sash arm connectable to the window sash, means pivotally connecting one end of the sash arm to said shoe, a support arm pivotally connected at one end in fixed relation to the track and pivotally connected at the other end thereof to the sash arm intermediate the ends of the sash arm for causing movement of the mounting shoe along the track as the window sash moves to and from the egress position wherein the sash arm extends generally normal to the track, and means associated with the support arm to permit further movement of the mounting shoe along the track to shift the sash arm and window sash from said egress position to a washability position.

A further object of the invention is to provide a hinge as defined in the preceding paragraph wherein said means associated with the support arm comprises an anchor shoe slidable in said track to which said one end of the support arm is pivotally connected, and releasable means for holding said anchor shoe against movement during said normal operations.

Still another object of the invention is to provide a hinge for a casement window providing for normal full opening of the window sash to an egress position and for movement therefrom to a washability position comprising, a track mountable on a window frame, a mounting shoe movable along the track, a sash arm connectable to the window sash, means pivotally connecting one end of the sash arm to said mounting shoe, a support arm pivotally connected at one end to the track and pivotally connected at the other end thereof to the sash arm intermediate the ends of the sash arm for causing movement of the mounting shoe along the track as the window sash moves to an egress position with the sash arm extending generally normal to the track, and means for reducing the effective length of the support arm when the window sash is in said egress position to permit further movement of the mounting shoe along the track to shift the sash arm and window sash from said egress position to a washability position.

BRIEF DESCRIPTION OF THE DRAWINGS

FIG. 4 is a plan view of the structure of FIG. 1 shown in window-washability position;

FIG. 5 is a sectional view, on an enlarged scale taken generally along the line 5—5 in FIG. 2;

FIG. 6 is a sectional view, on an enlarged scale taken generally along the line 6—6 in FIG. 2;

FIG. 7 is a sectional view, on an enlarged scale taken generally along the line 7—7 in FIG. 2;

BEST MODES FOR CARRYING OUT THE INVENTION

Figure 1:
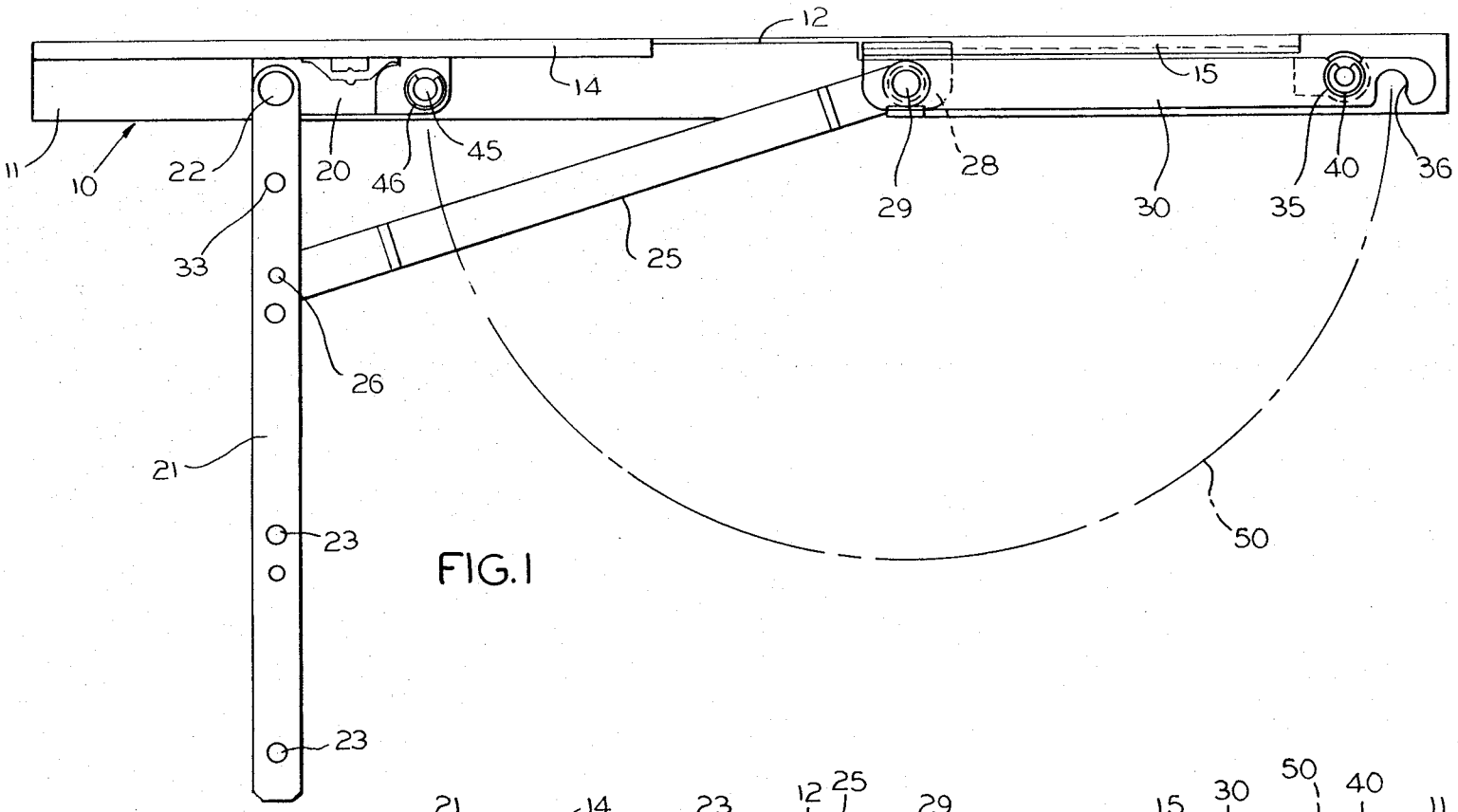
FIG. 1 is a plan view of a first embodiment of the hinge, showing the components in egress position.
Figure 2:
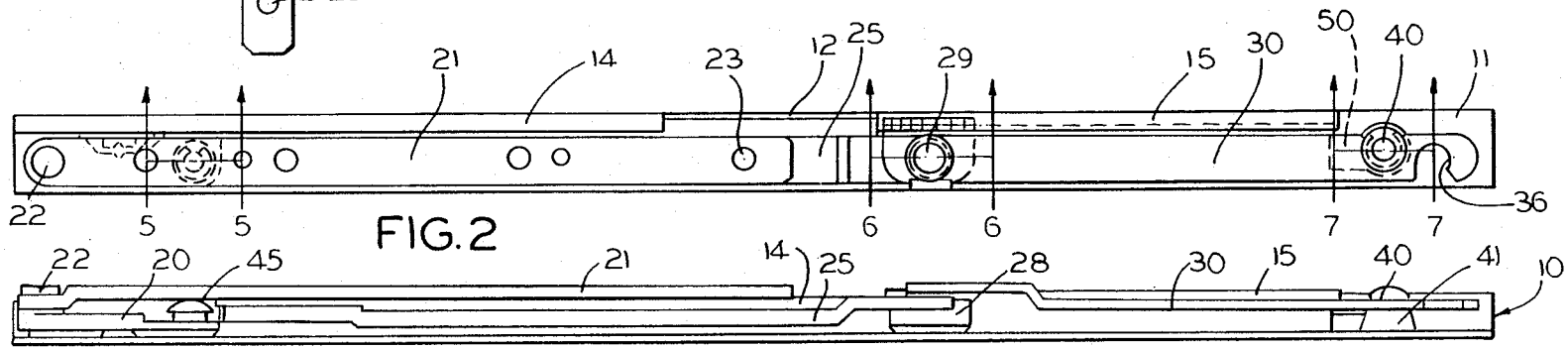
FIG. 2 is a plan view of the hinge, with the components in window-closed position.
Figure 3:
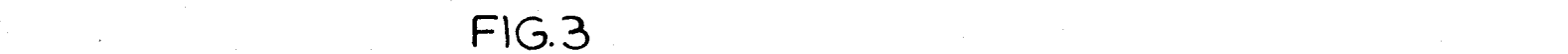
FIG. 3 is an elevational view of the structure shown in FIG. 2.

The first embodiment of the invention is shown in FIGS. 1 to 7.

An elongate track, indicated generally at 10, is mountable to a window frame and has a horizontally disposed planar portion 11 with an upstanding side wall 12, with a pair of spaced-apart, inwardly-turned flanges 14 and 15 overlying the horizontal section 11 of the track and which have down-turned ends to form guide channels for coacting shoe structures.

A mounting shoe 20, which is typically formed of a molded plastic, has an upturned flange slidably fitted within the guide channels associated with the flanges 14 and 15 and slides on the elongate track 10. The mounting shoe 20 pivotally mounts a sash arm 21 at a pivot connection 22, with the sash arm being attachable to the bottom of the window sash by fastening members (not shown) extended through openings 23. A comparably constructed hinge would be mounted to the top of the window sash to provide both top and bottom support for the window sash.

A support arm 25 is pivotally connected at one of its ends to the sash arm 21 at a distance from the pivotal mounting thereof to the mounting shoe 20 by means of a pivot connection 26. The other end of the support arm 25 is pivotally connected to an anchor shoe 28 by a rivet 29. With the anchor shoe 28 releasably held in the position shown in FIG. 1, the sash arm 21 can move between the closed position, shown in FIGS. 2 and 3, and the fully-open, egress position, shown in FIG. 1, by movement of the mounting shoe 20 along the track 10 and pivoting of the support arm 25 at the pivot connections 26 and 29 at the opposite ends thereof. In the egress position of FIG. 1, the window sash is positioned adjacent one side of the window frame, to maximize the window opening to facilitate escape through the window if required in an emergency.

The window hinge is shown positioned in a washability position in FIG. 4 wherein the sash arm 21 has moved to a position more nearly the middle of the length of the track 10. This moves the window sash to a position more nearly the center of the window opening whereby easy access may be had to both sides of the window sash for cleaning thereof.

The movement from the egress position of FIG. 1 to the washability position of FIG. 4 is achieved by further movement of the mounting shoe 20 along the track 10, which is permitted by releasing the anchor shoe 28 from its fixed relation with the track 10. The anchor shoe 28 is normally held in fixed relation by an anchor arm 30 which, at one end, is pivotally-mounted on the rivet 29 carried by the anchor shoe, as seen in FIG. 6, and is spaced from the support arm 25 by a washer 31. The anchor arm 30 is provided with a pair of oppositely-facing notches 35 and 36 adjacent an end thereof. The notch 35 coacts with a lock member in the form of a snap collar 38 surrounding a rivet 40 fixed to a raised part 41 of the track 10 as seen in FIG. 7 and this holds the anchor arm 30 to maintain the anchor shoe 28 in fixed position on the track.

As seen in FIG. 5, the mounting shoe 20 has a retention member comprising an insert 44 which fixedly mounts a rivet 45 which is surrounded by a snap collar 46. The anchor arm 30 can be manually released from the snap collar 38 by a force exerted in a clockwise direction, as viewed in FIG. 1, and the anchor arm pivoted through an arc, as indicated by the broken line 50 in FIG. 1 to a position wherein the notch 36 engages with the snap collar 46 to lock the anchor arm to the mounting shoe. This frees the anchor shoe 28 for movement along the track 10 and interlocks the anchor shoe with the mounting shoe 20 whereby the sash arm 21 can move to a washability position, as seen in FIG. 4. An end 50 of the raised part 41 of the track 10 forms a stop for engagement with the anchor shoe 28, as seen in FIG. 4, to limit the movement of the parts to a washability position.

After washing of the window, the mounting shoe 20 and anchor shoe 28 can be returned to the positions shown in FIG. 1 and the anchor arm 30 released from the snap collar 46 and returned into engagement with the snap collar 38. This restores the support arm 25 to a fixed pivoting position relative to the track 10 and there can then be normal operation of a window between closed and egress positions.

A second embodiment of the invention is shown in FIGS. 8 to 13 wherein a track, indicated generally at 60, is mountable on a window frame and is of generally the same construction as the left-hand part of the track shown in FIG. 1 with a horizontal planar section 61, a side wall 62 and a top flange 63 with a downwardly-depending channel for movably guiding a mounting shoe 65. The mounting shoe 65 can move along the track 60 and pivotally mounts a sash arm 70 at one end by a pivot connection 71. The sash arm 70 has a series of openings 72 for receiving fasteners (not shown) for attachment to the underside of a window sash whereby the sash arm and window sash can move between a closed position and the egress position shown in FIG. 8.

A support arm indicated generally at 75, is pivotally connected at one end to the sash arm at a distance from the mounting shoe 65 by a pivot connection 76 and at its other end is pivotally connected to the track by a pivot connection 77. In normal movements of the window, the components of the hinge can move from the closed position, shown in FIGS. 9 and 10, to the egress position, shown in FIG. 8. In order to move the window sash from egress position to a washability position shown in FIG. 11, the support arm 75 is constructed for adjustment of the effective length thereof.

Figure 8:
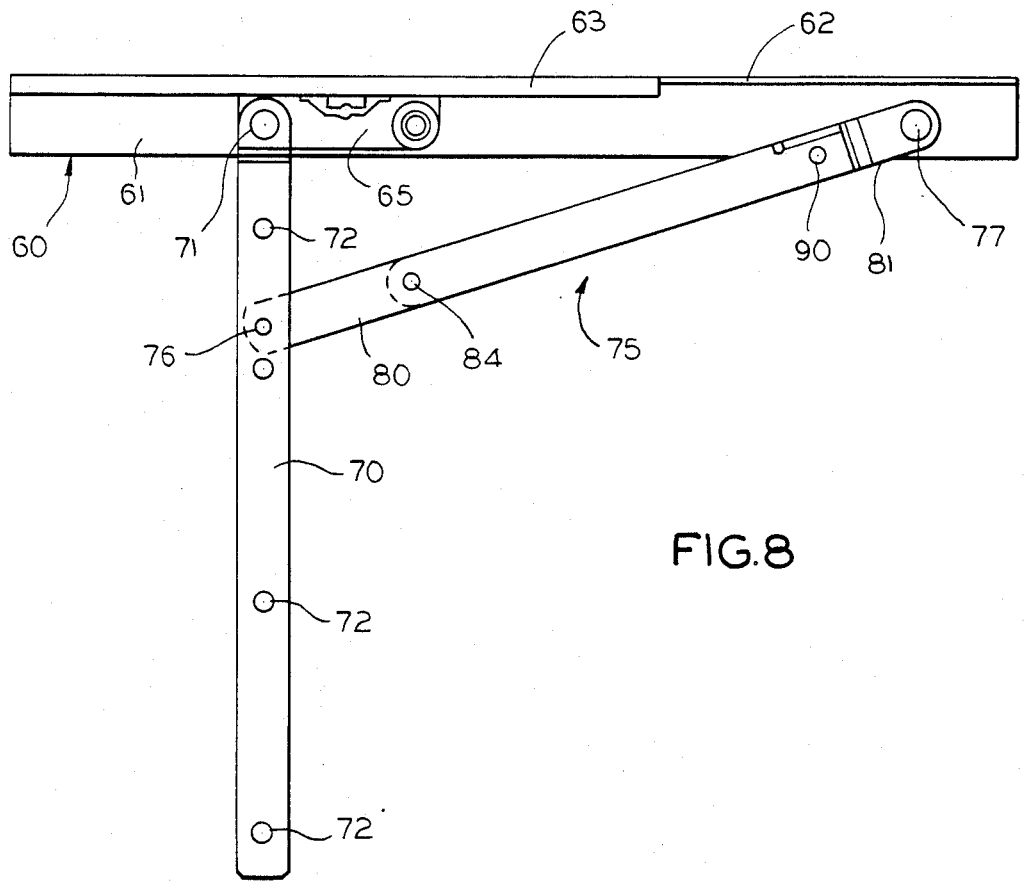
FIG. 8 is a plan view of a second embodiment of the hinge with the components shown in egress position.
Figure 9:
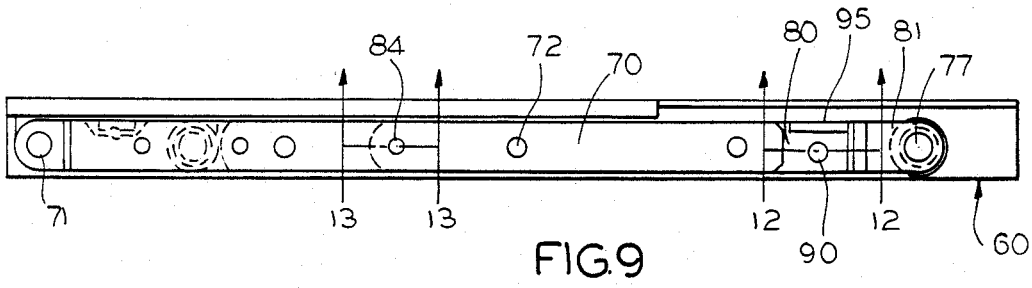
FIG. 9 is a plan view of the hinge shown in FIG. 8, with the components in closed position.
Figure 10:
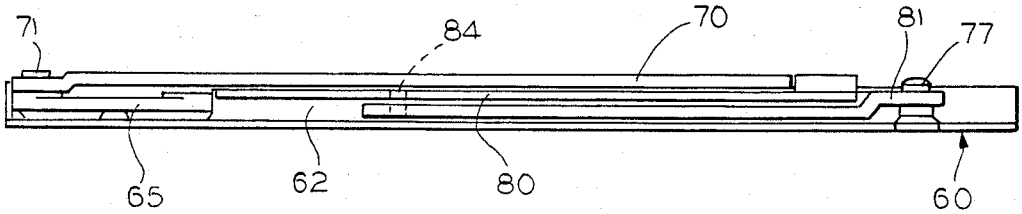
FIG. 10 is an elevational view of the structure shown in FIG. 9.

More specifically, the support arm is formed of two support arm sections. A first support arm section 80 is pivotally connected to the sash arm 70 by the pivot connection 76, previously referred to, and a second arm section 81 is pivotally connected to the track by the pivot connection 77, previously referred to. The two support arm sections 80 and 81 are pivotally connected together by means of a rivet 84, as seen particularly in FIG. 13, and with a washer 85 positioned therebetween. In normal operation, the support arm sections 80 and 81 are in straight-line, overlapped relation, as seen in FIG. 8. When the window sash is to be moved from the egress position of FIG. 8 to the washability position of FIG. 11, the support arm sections are caused to pivot relative to each other about the rivet 84 to bring the first support arm section 80 into general alignment with the sash arm 70 which reduces the effective length of the support arm whereby the mounting shoe 65 can more further to the right along the track 60.

Figure 11:
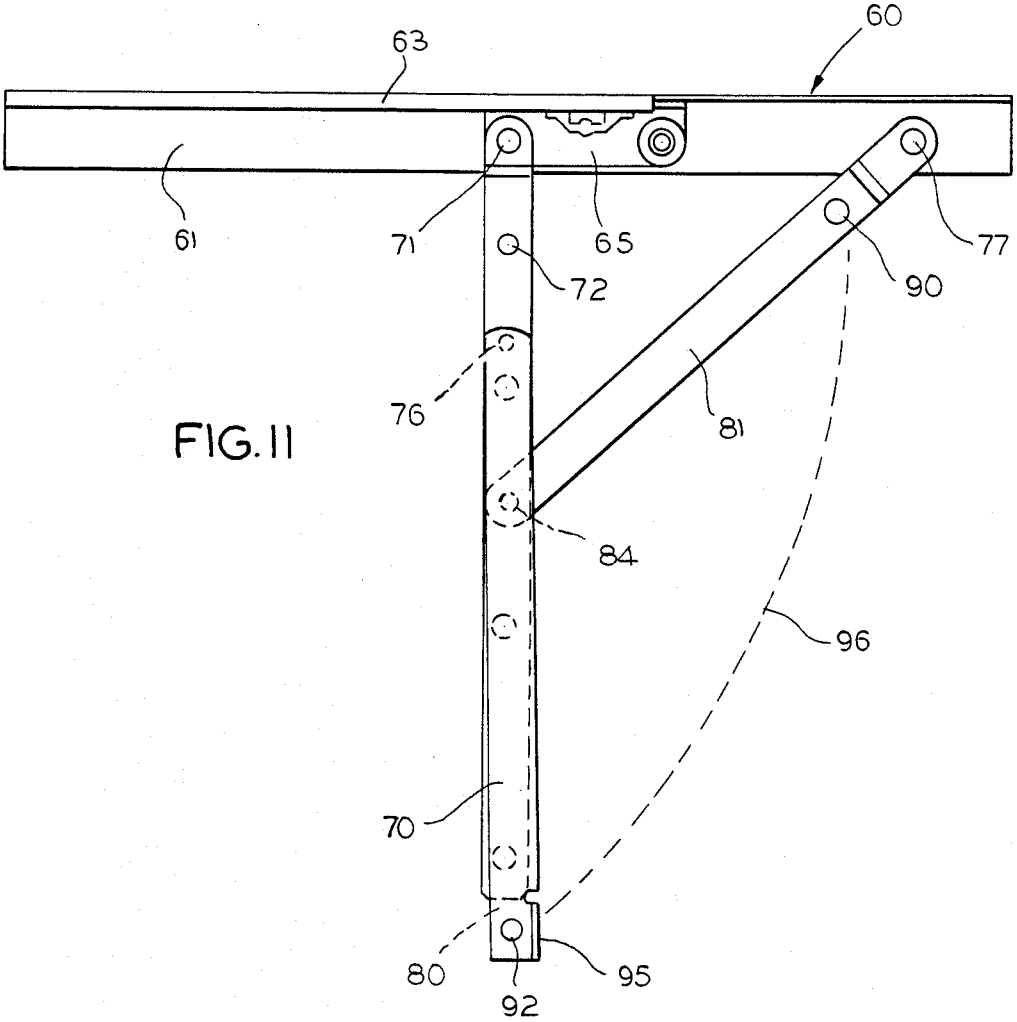
FIG. 11 is a plan view of the structure shown in FIG. 8, positioned in window-washability position.
Figure 12:
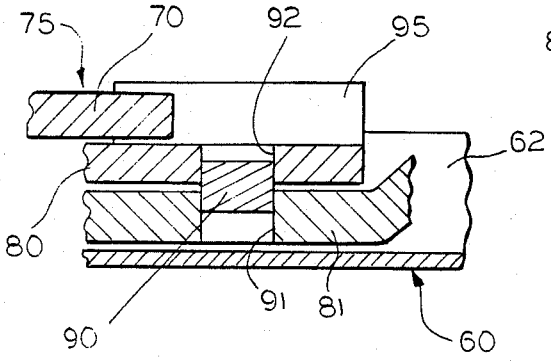
FIG. 12 is a sectional view, on an enlarged scale taken generally along the line 12—12 in FIG. 9.
Figure 13:
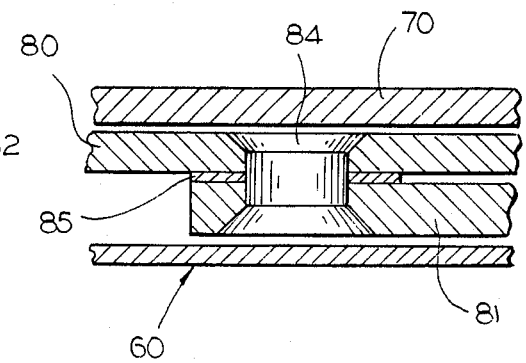
FIG. 13 is a sectional view, on an enlarged scale taken generally along the line 13—13 in FIG. 9.

The support arm sections 80 and 81 are normally held in aligned relation by releasable holding means in the form of a protruding slug 90 fitted within an opening 91 in the support arm section 81 and extending upwardly above the upper surface thereof, as shown in FIG. 12, for engagement within an opening 92 in the support arm section 80. The support arm section 80 has a tab 95 whereby the support arm section 80 can be pulled upwardly to free it from engagement with the protruding slug 90 and permit the movement of the support arm section 80 through an arc as shown by the broken line 96 in FIG. 11 to a position wherein the tab 95 will engage with the lower rail of the window sash and limit the pivotal movement thereof.

The movement of the support arm section 80 to the position shown in FIG. 11 shortens the effective length of the support arm to be the length of the support arm section 81 which enables the mounting shoe 65 to carry the sash arm to the washability position.

When the window is to be returned to the egress position from the washability position, the sash arm 70 is moved to the left, as viewed in FIG. 11, to the position shown in FIG. 8, which brings the support arm sections back into alignment and support arm section 80 can be reengaged with the protruding lug 90. Alternatively to grasping the tab 95 to raise the support arm section 80, the support arm section 80 can be pried upwardly for separation from the protruding lug 90.

A third embodiment of the invention is shown in FIGS. 14–18. A track, indicated generally at 100, has a horizontal planar length 101 with a side wall 102 and an overhanging flange 103 providing a guide channel for a mounting shoe 105. A sash arm 110 is pivotally mounted to the mounting shoe at 111 and has a series of openings 112 for fastening means (not shown) to secure the sash arm to the underside of a window sash. A support arm, indicated generally at 120, is pivotally connected at one of its ends to the sash arm at a distance from the mounting shoe 105 by the pivot connection 121 and the other end of the support arm is pivotally connected to the track 100 by a pivot connection 122.

The support arm 120 is formed of two support arm sections to enable varying the effective length thereof. A first support arm section 125 is pivotally connected to the sash arm 110 at the pivot connection 121, while a second support arm section 126 is pivotally connected to the track 100 by the pivot connection 122. The support arm sections are slidably interconnected by a pair of pin and slot connections. The first support arm section 125 has a slot 130 coacting with a pin 131 extending upwardly from the second support arm section 126. The second support arm section 126 has an elongate slot 135 coacting with a pin 136 depending downwardly from the first support arm section 125. Each of these pins is defined by a rivet, as seen particularly in FIG. 18, which has a head to hold the support arm sections together. A pair of washers 140 and 141 is positioned between the overlapping parts of the support arm sections and surrounding the rivets 131 and 136 to facilitate sliding movement of the support sections relative to each other.

Figure 14:
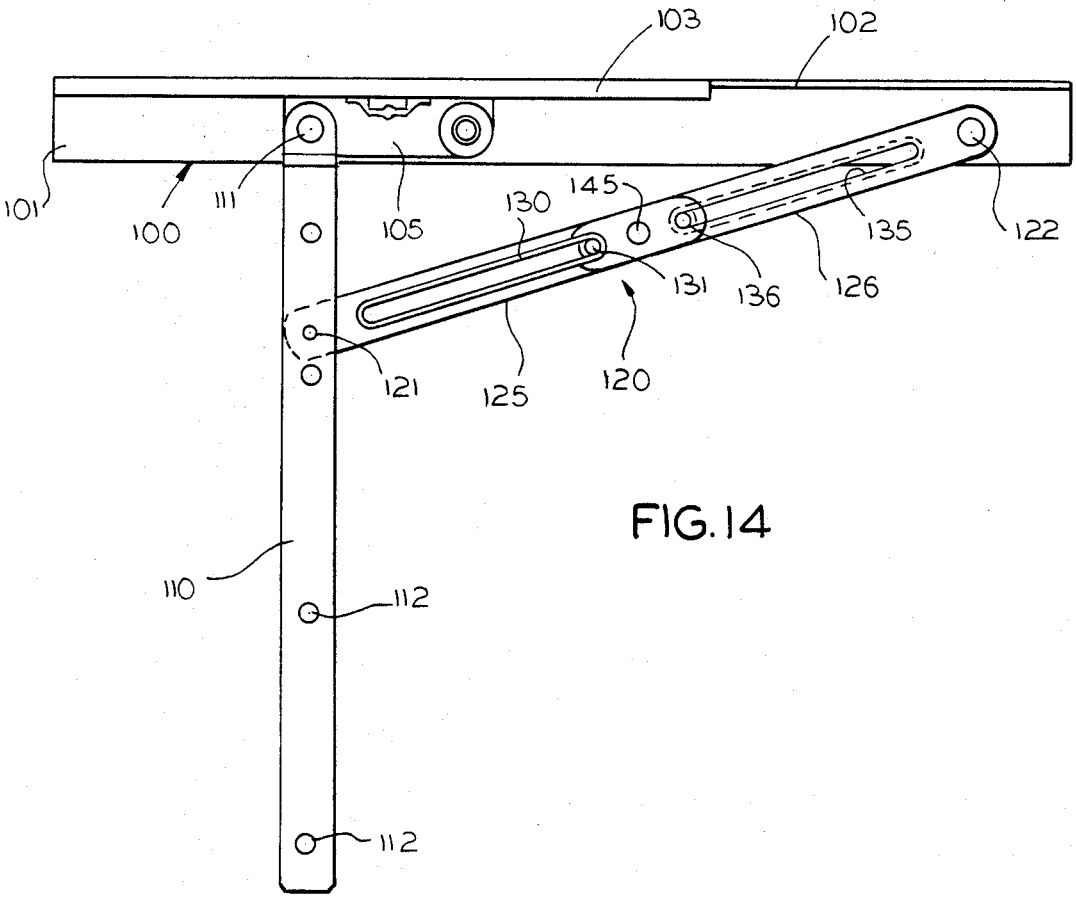
FIG. 14 is a plan view of a third embodiment of the hinge, with the components shown in egress position.
Figure 15:
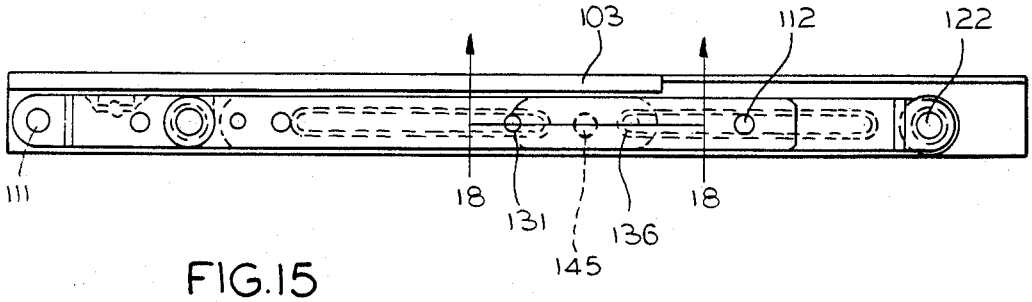
FIG. 15 is a plan view of the hinge shown in FIG. 14 with the components in closed position.
Figure 16:
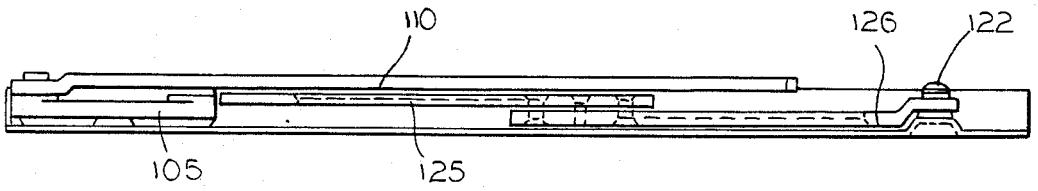
FIG. 16 is an elevational view of the structure shown in FIG. 15.
Figure 17:
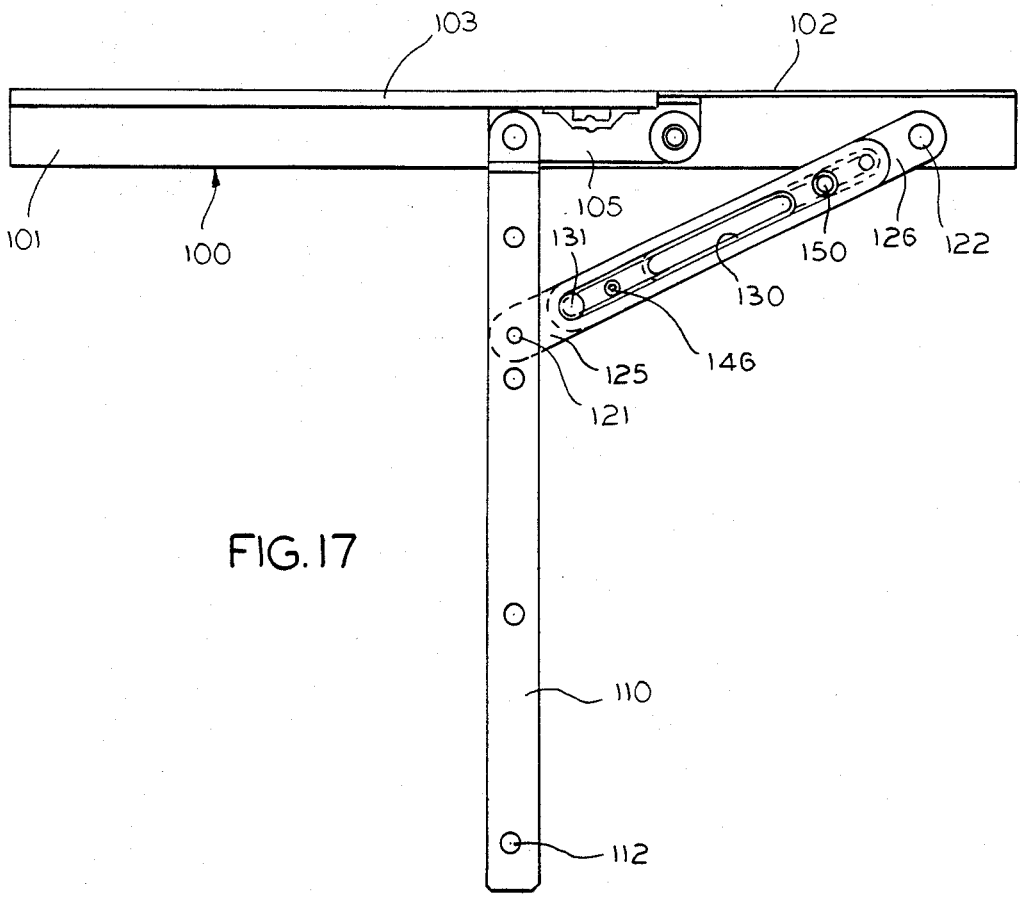
FIG. 17 is a plan view of the structure shown in FIG. 14 in washability position for the window.
Figure 18:
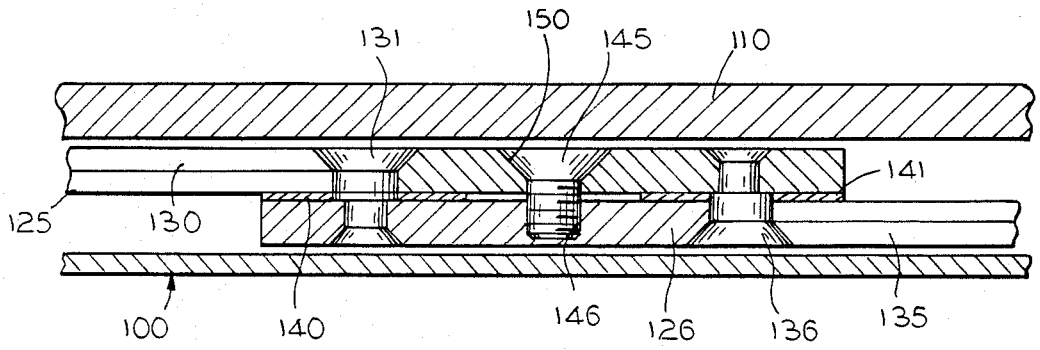
FIG. 18 is a sectional view, on an enlarged scale taken generally along the line 18—18 in FIG. 15.

The support arm sections 125 and 126 are held in a full effective length position, as shown in FIG. 14, by means of a removable screw 145 fitted within a countersink 150 in the first support arm section 125 and threaded at 146 into a threaded opening in the second support arm section 126. When the window sash is to be moved from an egress position, with the hardware positioned as shown in FIG. 14, to the washability position of FIG. 17, the screw 145 is removed which permits a lengthwise contraction of the support arm sections to enable movement of the mounting shoe 105 to the right to the position shown in FIG. 17. When the window is to be moved back to a position for normal operation, the sash arm 110 is moved to the left from the position of FIG. 17 to the position of FIG. 14, which brings the support arm sections into position for reinsertion of the screw 145 to secure the support arm at its maximum effective length, whereby the window can move between closed and egress positions.

The term "casement window" is used throughout the specification and claims in its broadest sense to mean a window having a sash movable on hinges regardless of whether pivoting is about a horizontal or vertical axis.

We claim:

1. A hinge for a casement window providing for normal operation of a window sash to and from an egress position and for movement therefrom to a washability position comprising, a track mountable on a window frame, a mounting shoe movable along the track, a sash arm connectable to the window sash, means pivotally connecting one end of the sash arm to said shoe, a support arm pivotally connected at one end in fixed relation to the track and pivotally connected at the other end thereof to the sash arm intermediate the ends of the sash arm for causing movement of the mounting shoe along the track as the window sash moves to and from the egress position wherein the sash arm extends generally normal to the track, and means associated with the support arm to permit further movement of the mounting shoe along the track to shift the sash arm and window sash from said egress position to a washability position without change in the angle of extension of the sash arm relative to the track including an anchor shoe slidable in said track to which said one end of the support arm is pivotally connected, and releasable means for locking said anchor shoe against movement during said normal operation.

2. A hinge for a casement window providing for normal operation of a window sash to and from an egress position and for movement therefrom to a washability position comprising, a track mountable on a window frame, a mounting shoe movable along the track, a sash arm connectable to the window sash, means pivotally connecting one end of the sash arm to said shoe, a support arm pivotally connected at one end in fixed relation to the track and pivotally connected at the other end thereof to the sash arm intermediate the ends of the sash arm for causing movement of the mounting shoe along the track as the window sash moves to and from the egress position wherein the sash arm extends at an angle to the track, means associated with the support arm to permit further movement of the mounting shoe along the track to shift the sash arm and window sash from said egress position to a washability position comprising, an anchor shoe slidable in said track to which said one end of the support arm is pivotally connected, releasable means for holding said anchor shoe against movement during said normal operation comprising an anchor arm pivotally connected to said anchor shoe, means on said track for releasably holding said anchor arm against pivotal movement to locate the anchor shoe in fixed relation to the track, and means on said mounting shoe to which the sash arm is pivotally connected for holding the anchor arm in a second position to lock said shoes together for movement along the track to move the window sash from said egress position to a washability position.

3. A hinge as defined in claim 2 including a stop on said track engageable by said anchor shoe to limit movement of the anchor shoe and establish said washability position.

4. A hinge for a casement window providing for normal operation of a window sash to and from an egress position and for movement therefrom to a washability position comprising, a track mountable on a window frame, a mounting shoe movable along the track, a sash arm connectable to the window sash, means pivotally connecting one end of the sash arm to said shoe, a support arm pivotally connected at one end in fixed relation to the track and pivotally connected at the other end thereof of to the sash arm intermediate the ends of the sash arm for causing movement of the mounting shoe along the track as the window sash moves to and from the egress position wherein the sash arm extends generally normal to the track, and means associated with the support arm to permit further movement of the mounting shoe along the track to shift the sash arm and window sash from said egress position to a washability position without change in the angle of extension of the sash arm relative to the track including means for varying the effective length of the support arm.

5. A hinge as defined in claim 4 wherein said support arm is formed of two relatively movable support arm sections which have a first effective length to control movement of the window sash to said egress position and a lesser effective length to permit movement of the window sash to said washability position.

6. A hinge as defined in claim 5 wherein said support arm sections are pivotally connected to each other.

7. A hinge as defined in claim 5 wherein said support arm sections are slidably connected to each other.

8. A hinge for a casement window providing for normal full opening of the window sash to an egress position and for movement therefrom to a washability position comprising, a track mountable on a window frame, a mounting shoe movable along the track, a sash arm connectable to the window sash, means pivotally connecting one end of the sash arm to said mounting shoe, a support arm fixed at one end to the track by a pivot and pivotally connected at the other end thereof to the sash arm intermediate the ends of the sash arm for causing movement of the mounting shoe along the track as the window sash moves to an egress position with the sash arm extending generally normal to the track, and means for reducing the effective length of the support arm when the window sash is in said egress position to permit further movement of the mounting shoe along the track to shift the sash arm and window sash from said egress position to a washability position without change in the angle of extension of the sash arm relative to the track.

9. A hinge for a casement window providing for normal full opening of the window sash to an egress position and for movement therefrom to a washability position comprising, a track mountable on a window frame, a mounting shoe movable along the track, a sash arm connectable to the window sash, means pivotally connecting one end of the sash arm to said mounting shoe, a support arm pivotally connected at one end to the track and pivotally connected at the other end thereof to the sash arm intermediate the ends of the sash arm for causing movement of the mounting shoe along the track as the window sash moves to an egress position with the sash arm extending at an angle to the track, said support arm being formed of two support arm sections with a first of the support arm sections movably mounted on the second of the support arm sections and extending beyond an end of the second support arm section in a straight-line relation, and means for reducing the effective length of the support arm when the window sash is in said egress position to permit further movement of the mounting shoe along the track to shift the sash arm and window sash from said egress position to a washability position including means for releasably locking the support arm sections together in said straight-line relation to define a support arm of a predetermined length and release of said releasable locking means permitting relative movement between said support arm sections to reduce the effective length of the support arm.

10. A hinge as defined in claim 9 wherein said first support arm section is pivotally mounted on the second arm section.

11. A hinge as defined in claim 9 wherein said first arm section is slidably mounted on said second arm section.

12. A hinge for a casement window comprising, in combination, an elongate track, a mounting shoe movably guided by said track for movement lengthwise thereof, a sash arm pivotally mounted at one end to said mounting shoe, a support arm having a first end pivotally mounted to said sash arm at a distance from said mounting shoe, means pivotally mounting a second end of the support arm in fixed overlying relation with the track whereby the sash arm can move from a window-closed to a window-egress postion by combined movement of the mounting shoe along the track and pivoting of the support arm about both of said pivot mountings including an anchor shoe movably mounted in said track, a lock member at an end of the track, an anchor arm pivotally connected at one end to said anchor shoe and releasably engageable with said lock member, and a retention member on said mounting shoe, said anchor arm having a length to engage said retention member when released from the lock member and rotated through an arc to engage the retention member whereby said shoes are locked together by the anchor arm and the anchor shoe is released for movement whereby the sash arm can move from a window-egress position to a window-washability position.

13. A hinge for a casement window comprising, in combination, an elongate track, a mounting shoe movably guided by said track for movement lengthwise thereof, a sash arm pivotally connected at one end to said mounting shoe, a support arm having a first end pivotally connected to said sash arm at a distance from said mounting shoe, means pivotally connecting a second end of the support arm in fixed overlying relation with the track whereby the sash arm can move from a window-closed to a window-egress position by combined movement of the mounting shoe along the track and pivoting of the support arm about both of said pivot connection, said support arm being formed of two support arm sections in partially overlapped relation, one support arm section having said pivot connection to the sash arm and the other support arm section having the pivot connection to the track, means pivotally interconnecting said support arm sections, means for releasably holding said support arm sections in aligned relation for movement of the sash arm between window-closed and window-egress positions, and said support arm sections being pivotal relative to each other to enable movement of the sash arm from a window-egress position to a window-washability position.

14. A hinge as defined in claim 13 wherein said means for releasably holding said support arm sections in aligned relation comprises a protruding lug on one support arm section and a lug-receiving opening in the other support arm section.

15. A hinge for a casement window comprising, in combination, an elongate track, a mounting shoe movably guided by said track for movement lengthwise thereof, a sash arm pivotally mounted at one end to said mounting shoe, a support arm having a first end pivotally connected to said sash arm at a distance from said mounting shoe, means pivotally connecting a second end of the support arm in fixed overlying relation with the track whereby the sash arm can move from a window-closed to a window-egress position by combined movement of the mounting shoe along the track and pivoting of the support arm about both of said pivot connections, said support arm being formed of two support arm sections in partially overlapped relation, a pair of pin and slot connections between said support arm sections enabling a variation in the overall length of the support arm, and releasable means for holding said support arm sections in a position to achieve maximum length of the support arm for movement of the sash arm between window-closed and window-egress positions with release of the holding means shortening the support arm to permit the sash arm to move from said window-egress position to a window-washability position.

16. A hinge as defined in claim 15 wherein said releasable means includes a removable screw interconnecting said support arm sections.

17. A hinge for a casement window providing for operation of a window sash to and from an egress position or to a washability position comprising, a track mountable on a window frame, a mounting shoe movable along the track, a sash arm connectable to the window sash, means pivotally connecting one end of the sash arm to said mounting shoe, a second shoe movable on the track, means for releasably locking the second shoe in a fixed position on the track, a support arm pivotally connected at one end to the second shoe and pivotally connected at the other end thereof to the sash arm intermediate the ends of the sash arm for causing movement of the mounting shoe along the track when the second shoe is locked in fixed position and the window sash moves to and from the egress position wherein the sash arm extends generally normal to the track, and the mounting shoe having further movement along the track when the second shoe is unlocked to shift the sash arm and window sash from said egress position to a washability position without change in the angle of extension of the sash arm relative to the track.

18. A hinge for a casement window providing for operation of a window sash to and from an egress position as well as for movement to a washability position comprising, a track mountable on a window frame, a mounting shoe movable along the track, a sash arm connectable to a window sash, means pivotally connecting one end of the sash arm to said shoe, a second shoe movable along the track, a support arm having a first pivot connection at one end to the second shoe and a second pivot connection at the other end thereof to the sash arm intermediate the ends of the sash arm, selectively operable means associated with the second shoe to either lock the second shoe against movement relative to the track whereby said first pivot connection is fixed and the support arm controls sash arm movement to and from said egress position or to unlock the second shoe and permit movement of said second shoe along the track, and means for interconnecting both of said shoes when the second shoe is unlocked to cause both of said shoes to move together along the track in response to manually-applied force for movement of the sash arm to said washability position.

* * * * *